United States Patent [19]

Casey

[11] 3,986,352

[45] Oct. 19, 1976

[54] CLOSED LOOP FUEL CONTROL USING AIR INJECTION IN OPEN LOOP MODES

[75] Inventor: Gary L. Casey, Troy, Mich.

[73] Assignee: General Motors Corporation, Detroit, Mich.

[22] Filed: May 8, 1975

[21] Appl. No.: 575,984

[52] U.S. Cl. ..... 60/276; 60/284; 60/285; 60/289; 60/294

[51] Int. Cl.[2] ..... F02B 75/10

[58] Field of Search ..... 60/276, 285, 289, 290, 60/294, 284

[56] References Cited

UNITED STATES PATENTS

| | | | |
|---|---|---|---|
| 3,745,768 | 7/1973 | Zechnall | 60/276 |
| 3,805,522 | 4/1974 | Sheppard | 60/290 |
| 3,832,848 | 9/1974 | Scholl | 60/276 |
| 3,863,444 | 2/1975 | Nakajima | 60/289 |

*Primary Examiner*—Douglas Hart
*Attorney, Agent, or Firm*—Robert M. Sigler

[57] ABSTRACT

A fuel control for an engine is normally operated closed loop with a feedback signal from an air-fuel ratio sensor in the engine exhaust. However, during idle, wide open throttle and engine warm up operating modes, the closed loop control is cut out and the engine is run rich with air injected into the exhaust system to reduce carbon monoxide and hydrocarbon emissions.

2 Claims, 1 Drawing Figure

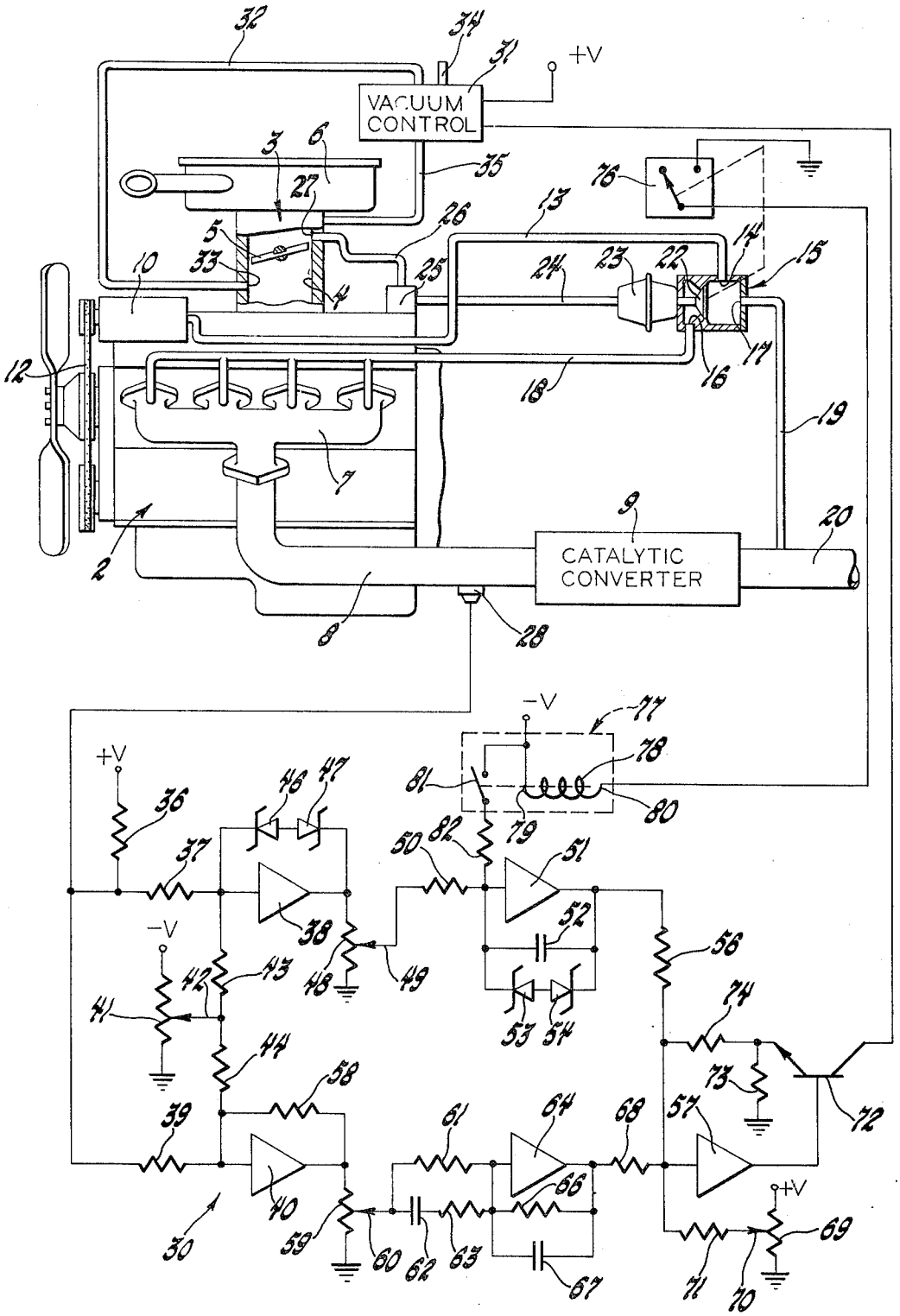
VACUUM CONTROL
CATALYTIC CONVERTER
+V
-V

CLOSED LOOP FUEL CONTROL USING AIR INJECTION IN OPEN LOOP MODES

BACKGROUND OF THE INVENTION

A device which has been found useful in the reduction of undesirable emissions from the exhaust of internal combustion engines is the catalytic converter. It has been found that a catalytic device with a noble metal catalyst such as platinum or palladium, when supplied with an exhaust gas mixture containing oxygen and hydrocarbon fuel in a ratio maintained within a narrow "window" around stoichiometry, shows high efficiency in simultaneously oxidizing carbon monoxide and unburned hydrocarbons and reducing oxides of nitrogen. However, the only way to maintain air-fuel ratio within such narrow limits is with a closed loop control system, many of which have been proposed.

One way of accomplishing such a closed loop system is to provide a zirconia sensor in the engine exhaust system with appropriate signal processing electronics to control air-fuel ratio adjustment means in a standard engine carburetor. This approach has at least one attractive feature in that the feedback control elements can be basically added on to existing engines, which fact facilitates adoption of the method and may minimize the additional cost.

An engine with standard carburetor and zirconia exhaust sensor, however, has certain modes of operation in which closed loop control is not practical. These include closed throttle operation or idling, wherein a constant ratio idle jet rather than the controlled main jet supplies fuel to the engine, and cold start operation, since a zirconia sensor does not produce a useful output signal until raised to a minimum operating temperature. In addition, as is the case in many proposed systems, if engine induction vacuum is used to transmit the signal at some point in the feedback loop, this vacuum will fall to an unusable level during wide-open throttle engine operation. Thus open loop fuel control, with possible higher emissions, is necessary during these modes of engine operation.

Over any total period of engine use, a substantial portion of that period will be spent in the normal operating mode where closed loop control is practical and low emissions are obtained. Some portion of this period, however, will be spent in one of the modes in which open loop control is necessary and the total average engine emissions will thus depend partly upon the level of open loop engine emissions.

SUMMARY OF THE INVENTION

This invention is therefore directed toward means for combining closed loop and open loop fuel control on a carburetor equipped engine to reduce the total emissions therefrom. In particular, this invention provides a carburetor equipped engine with an exhaust mounted sensor and associated electronics to generate a signal indicative of air-fuel ratio which is fed back to the carburetor air-fuel ratio adjustment means in closed loop control, an air pump with output valve means effective to selectively apply the pressurized air to the exhaust means and appropriate temperature and throttle position sensitive means for sensing those operating modes where closed loop control is impractical, directing the sensor associated electronics to generate a signal demanding a rich carburetor mixture during those modes and directing the pump output valve means to provide air to the exhaust means from the pump for oxidation of the rich exhaust gases. Further details and advantages of this invention will be apparent from the accompanying figure and following description of a preferred embodiment.

DESCRIPTION OF THE PREFERRED EMBODIMENT

Referring to the FIGURE, an engine 2 receives a mixture of air and fuel from a carburetor 3 through an induction passage 4 which contains a throttle valve 5. The air enters carburetor 3 through an air cleaner 6 while the fuel is supplied by standard means not shown. Carburetor 3 contains standard means for mixing air and fuel including means for varying air-fuel ratio according to a vacuum signal. For simplicity, such means are not shown in this FIGURE; but an example can be seen in U.S. patent application Ser. No. 343,553 now U.S. Pat. No. 3,882,206 of John A. Gural et al., filed Mar. 21, 1973.

Engine 2 is equipped with an exhaust manifold 7 for receiving exhaust gases from the cylinders and conducting them to an exhaust conduit 8 leading to a catalytic converter 9. Catalytic converter 9 contains a noble metal or other catalyst capable, when supplied with engine exhaust gases and air in an approximately stoichiometric ratio, to simultaneously oxidize carbon monoxide and hydrocarbons and reduce oxides of nitrogen with high efficiency.

Engine 2 drives an air pump 10 through a belt 12 in the normal manner. Air pump 10 supplies pressurized air through a conduit 13 to the inlet 14 of a control valve 15. Control valve 15 has a pair of outlets 16 and 17, outlet 16 communicating through a conduit 18 with exhaust manifold 7 and outlet 17 communicating through a conduit 19 with an exhaust conduit 20 conducting exhaust gases from catalytic converter 9. Outlet 17 could alternatively be communicated to atmosphere directly through an optional sound muffling means.

Valve 15 contains a valve member 22 movable between a first position, shown in the FIGURE, effective to close outlet 16 and communicate inlet 14 with outlet 17 and a second position effective to close outlet 17 and communicate inlet 14 with outlet 16. The position of valve member 22 is controlled by a vacuum motor 23 of the standard type including a spring biased diaphragm, not shown, and supplied with ported induction vacuum through conduit 24, thermal vacuum valve 25 and conduit 26 from a ported vacuum port 27 in induction passage 4. Ported vacuum port 27 is well known in carburators: a port in the wall of induction passage 4 positioned just above the upward swinging end of throttle valve 5 in its closed position so that it is exposed to practically no induction vacuum when throttle valve 5 is fully closed or fully opened but substantial induction vacuum when throttle valve 5 is partly opened. Thermal vacuum valve 25 is also a well known device mounted in thermal contact with engine 2 and comprising a temperature sensitive valve which communicates conduits 24 and 26 when the temperature of engine 2 is greater than a reference temperature indicative of normal engine operation and cuts off communication between conduits 24 and 26 when the temperature of engine 2 is below the reference value during engine warm up.

An exhaust sensor 28 capable of producing an output voltage changing greatly with air-fuel ratio in the vicinity of stoichiometry is disposed in conduit 8. A good example of such a sensor is the well known zirconia sensor which measures the concentration of oxygen in excess of that required to combine with oxidizable substances in the exhaust stream. The output signal from sensor 28 is provided for processing to an electrical control circuit 30, the output of which is fed through a regulated vacuum control valve 31. Vacuum control valve 31 receives engine manifold vacuum through a conduit 32 from manifold vacuum port 33 located below throttle valve 5 in induction passage 4, receives air from the atmosphere through air inlet 34, which may be provided with a small air filter, not shown, and supplies a vacuum signal, regulated against changes due to varying engine manifold vacuum and varied according to the output of circuit 30, through a conduit 35 to the air-fuel ratio control means of carburetor 3.

Referring to circuit 30, the output signal of sensor 28 is supplied through a resistor 37 to the input of an operational amplifier 38 and through a resistor 39 to the input of an operational amplifier 40. A power supply, not shown, provides potentials of +V, ground and −V. A resistor 41 connected beteen potential −V and ground has a movable tap 42 which provides a reference through a resistor 43 to the input of operational amplifier 38 and another reference through a resistor 44 to the input of operational amplifier 40. A resistor 36 also connects potential +V to the input of operational amplifier 38.

The output of operational amplifier 38 is connected through a feedback path of back-to-back connected zener diodes 46 and 47 to its input and through a resistor 48 to ground. A movable tap 49 of variable resistor 48 is connected through a resistor 50 to the input of an operational amplifier 51. The output of operational amplifier 51 is fed back through a capacitor 52 in parallel with back-to-back connected zener diodes 53 and 54 to its input and also supplied through a resistor 56 to the input of an operational amplifier 57.

The output of operational amplifier 40 is connected through a resistor 58 to its input and through a resistor 59 to ground. A movable tap 60 on resistor 59 is connected through a resistor 61 in parallel with a series connected capacitor 62 and resistor 63 to the input of an operational amplifier 64. The output of operational amplifier 64 is connected through a resistor 66 and parallel capacitor 67 to its input and through a resistor 68 to the input of operational amplifier 57. A resistor 69, connected between potential +V and ground, has a movable tap 70 connected through a resistor 71 to the input of operational amplifier 57.

The output of operational amplifier 57 is applied to the base of a power transistor 72, the collector of which is connected through the actuating coil of vacuum control valve 31 to potential +V. The emitter of transistor 72 is connected through a resistor 73 to ground and through a resistor 74 to the input of operational amplifier 57.

A switch 76 is associated with control valve 15 and ganged to valve member 22 so that it is in an open position when valve member 22 is in its first position, shown in the FIGURE, and it is moved to a closed position when valve member 22 moves to its second position. A relay 77 includes an actuating coil 78 having one end 79 connected to potential −V and another end 80 connected through switch 76 to ground. The one end 79 is also connected through a normally open relay armature 81 and a resistor 82 to the input of operational amplifier 51.

The operation of circuit 30 will now be described. The signal from sensor 28 is fed to two parallel paths, one comprising operational amplifiers 38 and 51 and the other comprising operational amplifiers 40 and 64. Operational amplifier 38 and its associated elements form a comparator which produces an output voltage which assumes one of two values according to which of the signal input applied through resistor 37 or the reference input applied through resistor 43 is greater at any particular time. Operational amplifier 51 with its associated elements integrates the output of operational amplifier 38 with respect to time and applies the time integral to the summing amplifier 57. The effect of the comparator 38 is to square the signal from sensor 28 to prevent long term drift due to unsymmetrical changes with respect to the desired operating point in the output signal characteristics of sensor 28 caused by changing temperature or sensor age.

In the second branch, operational amplifier 40 amplifies the sum of the signal input applied through resistor 39 and the reference input applied through resistor 44. The output of amplifier 40 is applied proportionately through resistor 61 and with phase lead or time differentiation through capacitor 62 and resistor 63 to amplifier 64. The proportional and phase lead signal from amplifier 64 is summed in summing amplifier 57 with the integral signal from amplifier 51 and a reference from potential +V through resistors 69 and 71. Amplifier 57, however, also combines with resistors 73 and 74 and power transistor 72 to comprise a current source which drives the coil in vacuum control valve 31 according to the signal output of amplifier 57.

Electrical circuit 30 is only one example of a feedback control circuit that could be used in this invention. Those skilled in the art of feedback control systems will recognize that there are many ways of processing a feedback control signal to vary system response in speed or stability and that there are many ways of realizing any particular type of processing with different specific arrangements of electronic components.

The overall operation of this invention will now be described. During normal engine operation, that is, part throttle operation with a warm engine, thermal valve 25 is open to provide motor 23 with induction vacuum and hold valve member 22 and switch 76 in the positions shown. In relay 77, there is no current through actuating coil 78 and armature 81 is open. Vacuum control valve 31 is adjusted by circuit 30 according to the signal from sensor 28 as processed in circuit 30 to maintain a substantially constant air-fuel ratio in induction passage 4, and therefore in exhaust passage 8, near stoichiometry. Simultaneous high efficiency oxidation and reduction of undesirable exhaust constituents occurs in catalytic converter 9. The air from pump 10 is dumped to the atmosphere.

If throttle valve 5 closes past ported vacuum port 27 to its closed position or opens to its wide-open position, the level of vacuum supplied to vacuum motor 23 drops drastically; valve member 22 moves to the right to its other position; and switch 76 closes. With switch 76 closed, relay coil 78 is energized to close armature 81 and supply a low voltage from potential −V through resistor 82 to the input of operational amplifier 51. This low voltage overrides any input from operational amplifier 38 through resistor 50 and causes the output of power transistor 72 to swing to a demand for maximum richness. Carburetor 3 is calibrated for a specified maximum richness due to the feedback signal, although additional fuel may be supplied through a conventional accelerator pump arrangement for wide-open throttle acceleration if desired.

In burning a rich air-fuel ratio, engine 2 will emit very low oxides of nitrogen but high carbon monoxide and hydrocarbons. However, due to the position of valve member 22, air is supplied from pump 10 through conduit 18 to exhaust manifold 7 for oxidation of the latter constituents in manifold 7, conduit 8 and catalytic converter 9.

Similarly, during cold engine operation, thermal valve 25 will be closed, thus cutting off vacuum to vacuum motor 23 and resulting in the same combination of rich air-fuel ratio and air injection to manifold 7.

The rich air-fuel ratio supplied to engine 2 during closed throttle, wide-open throttle and engine warm up operation improves the smoothness and reliability of engine operation during those conditions as compared with the usual lean burning open loop operation suggested for zirconia signal controlled carburetor fuel systems. Engine 2 is thus able to operate dependably and smoothly with low emissions in all phases of engine operation.

One additional element in the system is resistor 36, the reason for which will now be explained. It may happen that, engine 2 having been operated until completely warm, turned off for a short period and then restarted, engine 2 will retain most of its heat but exhaust sensor 28, removed from the mass of engine 2, may have cooled to a temperature below its effective operating temperature. In this case, thermal vacuum valve 25 will allow closed loop operation; although a reliable signal may not be provided by sensor 28. When sensor 28 is cold, its output is low and its internal impedance is very high. Under such conditions, resistor 36 supplies a signal to amplifier 38 indicating a rich mixture, which results in a signal to vacuum control valve 31 to drive the carburetor mixture lean. Since the engine 2 is warmed up, it will operate satisfactorily on the lean mixture while sensor 28 quickly rises to its operating temperature. Of course, during this period of sensor warm up, the movement of throttle valve 5 to its closed or wide-open throttle position will still be effective to cause a rich mixture with air injection to manifold 7 as described above.

Although the above-described embodiment is preferred, those skilled in the art will readily conceive equivalent embodiments of this invention. Therefore, the scope of this invention should be limited only by the claims which follow.

The embodiments of the invention in which an exclusive property or privilege is claimed are defined as follows:

1. A fuel control system for a combustion engine having an exhaust conduit including a catalytic converter, the fuel control system comprising: means for supplying air and fuel to the engine including a throttle for varying the rate of supply of air and fuel and control means for varying the ratio of air and fuel supplied; means in the exhaust conduit effective to generate a signal indicative of exhaust, and therefore engine, air-fuel ratio feedback control means normally responsive to the exhaust gas composition signal to generate and apply to the air-fuel ratio control means an error signal tending to change air-fuel ratio in the direction of a constant ratio near stoichiometry, whereby the engine air-fuel supply is normally maintained at the constant ratio to enhance simultaneous oxidation and reduction of exhaust constituents within the catalytic converter; an engine driven air pump; means responsive to engine temperature and effective to generate a cold engine signal when the engine temperature is lower than a reference temperature; means responsive to the throttle to generate a closed throttle signal and a wide-open throttle signal during the named respective throttle conditions; and air control valve responsive to the temperature switch and throttle signal generating means to direct air from the air pump to the exhaust conduit upstream from the catalytic converter in response to one of the cold engine signal, closed throttle signal and full open throttle signal; and means responsive to the air control valve to generate and apply to the feedback control means, when air is being directed from the air pump to the exhaust conduit, an override signal indicative of an air-fuel ratio leaner than the constant ratio and effective to override the exhaust composition signal, whereby during cold engine, closed throttle and full open throttle operating conditions, the air-fuel ratio is maintained richer than the constant ratio for smooth engine operation and low nitrogen oxide formation and air is mixed with exhaust gases prior to the catalytic converter for oxidation of hydrocarbons and carbon monoxide.

2. A fuel control system for a combustion engine having an exhaust conduit with a catalytic converter, the system comprising: a carburetor effective to supply a mixture of air and fuel to the engine, the carburetor including a main induction passage with a throttle valve therein and ported engine induction vacuum port in the main induction passage positioned adjacent the throttle valve so as to be upstream from the throttle valve when the throttle valve is closed but downstream from the throttle valve and thus exposed to engine induction vacuum when the throttle valve opens, the carburetor further including means for varying the air-fuel ratio of the mixture; means in the exhaust conduit effective to generate a signal indicative of exhaust gas and therefore engine air-fuel ratio; feedback control means normally responsive to the air-fuel ratio signal to generate and apply to the air-fuel ratio control means an error signal tending to continuously change engine air-fuel ratio to reduce deviations therein from a constant ratio near stoichiometry, whereby the air-fuel ratio is normally maintained at the constant ratio to enhance simultaneous oxidation and reduction of exhaust constituents within the catalytic converter; an engine driven air pump; an air conduit connecting and conducting air from the air pump to the exhaust conduit upstream from the catalytic converter; an air valve in the air conduit, the air valve having a vacuum motor effective to open the air valve when provided with vacuum and close the air valve when not provided with vacuum; a vacuum conduit connecting the vacuum motor with the ported vacuum port and normally effective to provide vacuum sufficient to open the air valve when the throttle valve is partly open and insufficient to open the air valve when the throttle valve is closed or wide open; means in the vacuum conduit responsive to engine temperature to open the vacuum conduit above a reference engine temperature and close the vacuum conduit below the reference engine temperature; and a control switch responsive to air valve position to generate and apply to the feedback control means, when the air valve is open, a signal effective to override the air-fuel ratio signal and simulate a signal indicative of an air-fuel ratio leaner than the constant ratio, whereby, during cold engine, closed throttle and wide open throttle engine operation, the air-fuel ratio is maintained richer than the constant ratio for smooth operation and low oxides of nitrogen formation and air is mixed with the exhaust gases upstream from the catalytic converter for oxidation of hydrocarbons and carbon monoxide.

* * * * *